United States Patent [19]

Nasu

[11] 4,434,329

[45] Feb. 28, 1984

[54] MICROPHONE DEVICE BUILT IN A TAPE RECORDER

[75] Inventor: Mitsuo Nasu, Tokyo, Japan

[73] Assignee: Olympus Optical Company Limited, Tokyo, Japan

[21] Appl. No.: 348,339

[22] Filed: Feb. 12, 1982

[30] Foreign Application Priority Data

Feb. 19, 1981 [JP] Japan ..... 56-22416[U]
Feb. 19, 1981 [JP] Japan ..... 56-22417[U]

[51] Int. Cl.[3] ..... H04R 1/28

[52] U.S. Cl. ..... 179/121 R; 179/146 R; 179/179; 179/180; 179/187

[58] Field of Search ..... 455/100, 128; 179/179, 179/1 HF, 1 MG, 121 D, 146 R, 121 R, 107 R, 108 R, 180, 184, 187, 188

[56] References Cited

U.S. PATENT DOCUMENTS

| | | | |
|---|---|---|---|
| 3,692,264 | 9/1972 | Burkhard et al. | 179/179 X |
| 3,947,646 | 3/1976 | Saito | 179/146 R |
| 3,991,285 | 11/1976 | Van Den Worm et al. | 179/121 X |
| 4,174,469 | 11/1979 | Kusuyama | 179/179 X |
| 4,232,205 | 11/1980 | Ribeyre | 179/146 R |

FOREIGN PATENT DOCUMENTS

| | | | |
|---|---|---|---|
| 53-92121 | 8/1978 | Japan | 179/146 R |

OTHER PUBLICATIONS

"Microphone Suspension and Noise Shield", R. Linton, R. A. Maddox and H. Portig, *IBM Technical Disclosure Bulletin*, vol. 14, No. 6, Nov. 1971, pp. 1781-1782.

*Primary Examiner*—G. Z. Rubinson
*Assistant Examiner*—Danita R. Byrd
*Attorney, Agent, or Firm*—Toren, McGeady and Stanger

[57] ABSTRACT

A microphone device arranged to be built in a super-miniature tape recorder is disclosed. The device includes a casing portion of a tape recorder, a face member fixed on the casing portion and having a plurality of sound inlet holes, a first metallic support member supported by the face member for isolating vibrations of relatively low frequency, a second support member supported by the first support member for isolating vibrations of relatively high frequency, and a microphone body supported by the second support member in operative relation to the face member. A pair of bare conductive wires lead out of the microphone body, and each has a diameter of 0.15 mm or less.

8 Claims, 1 Drawing Figure

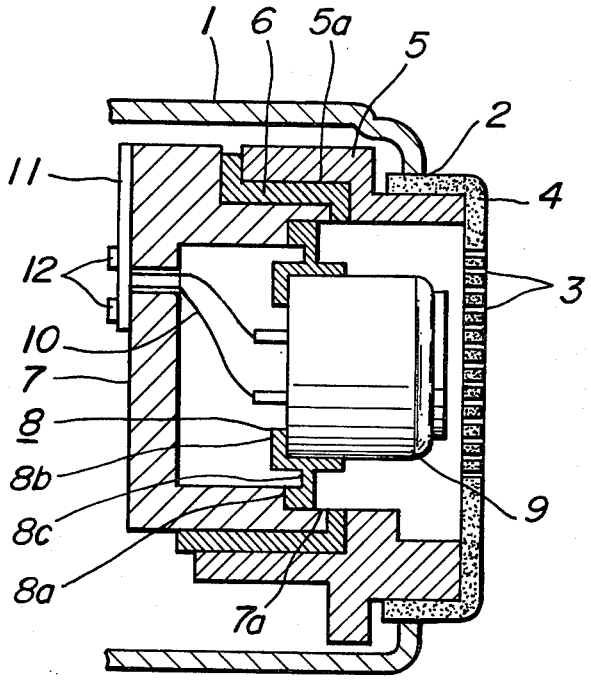
1
6
5a
5
2
11
4
12
3
10
7
8
8b
9
8c
8a
7a

MICROPHONE DEVICE BUILT IN A TAPE RECORDER

BACKGROUND OF THE INVENTION

The present invention relates to a microphone device built in a tape recorder for improved vibration isolating effect.

A tape recorder, generally, comprises a drive mechanism for driving a magnetic recording tape and a loudspeaker for generating reproduced sounds, so that mechanical vibrations are generated from a driving section, such as a drive motor and a rotating mechanism, and the loudspeaker. These vibrations are transmitted or propagated to a microphone device built in the tape recorder, through a casing of the recorder or the air, resulting in a cause of noise generation.

In order to isolate vibrations transmitted to the microphone through the casing of the tape recorder body so as to improve S/N ratio of the microphone, it has previously been proposed to support the microphone body by an elastic member such as rubber.

Such elastic member can isolate mechanical vibrations of high frequency from those vibrations transmitted through the tape recorder body.

On the one hand, such elastic member, however, can not obtain sufficient vibration isolating effect for vibrations of low frequency. This means that a complete vibration isolating effect can not be attained by such a construction because of increased performance capabilities of microphones. Accordingly, there remains the possibility of impairing the operation of the microphone.

Such vibrations, on the other hand, are transmitted not only through the microphone body but also through covered conductive wires which electrically connect the microphone body to electric circuits provided in the tape recorder body. When a hard and thick wire element is used as a covered conductive wire, it is liable to transmit vibrations so that a vibration isolating effect can not be fully obtained.

SUMMARY OF THE INVENTION

It is an object of the present invention to eliminate the above described disadvantages of conventional microphone devices.

It is another object of the present invention to provide a microphone device built in a tape recorder in which a microphone body is supported by one support member consisting of elastic material for isolating vibrations of high frequency, and is fitted to a tape recorder body through another support member of metal material arranged to isolate vibrations of low frequency, so that an effect of isolating vibrations of high and low frequencies can be greatly improved and the capability of a high performance microphone can be fully realized.

It is a further object of the present invention to provide a microphone device built in a tape recorder in which a microphone body is electrically connected to electric circuits provided in the tape recorder through bare conductive wires of 0.15 mm in diameter so that vibrations of high frequency transmitted through the bare conductive wires can fully be isolated and the vibrations isolating effect can be greatly improved.

According to the present invention there is provided a microphone device built in a tape recorder, comprising a casing of a tape recorder, a face member connected to the casing and having a plurality of sound inlet holes, a first support member connected to the face member for isolating vibrations of low frequency, a second support member connected to the first support member for isolating vibrations of high frequency, and a microphone body supported by the second support member.

The first support member is made of metal material and is formed in the shape of a tubular body having a bottom wall. The second support member is formed of elastic material having sufficient elasticity to isolate the high frequency vibrations. The microphone device further comprises a frame member supported by the face member, wherein the first support member is supported by the frame member through an elastic member. The first support member also may be cast with the frame member as a unit body.

The microphone further comprises a pair of bare conductive wires led out of the microphone body and having 0.15 mm or less diameter. The bare conductive wires are connected to an intermediate terminal plate provided in the tape recorder body. The bare conductive wires are connected to electrical circuits provided in the tape recorder body.

BRIEF DESCRIPTION OF THE DRAWING

With reference to the accompanying drawing,

The single FIGURE is a longitudinal sectional view showing one embodiment of a microphone device built in a tape recorder according to the present invention.

DESCRIPTION OF THE PREFERRED EMBODIMENT

Referring now to the drawing, there is shown an embodiment of a microphone device built in a tape recorder according to the present invention. In the drawing, a casing 1 of a superminiature cassette tape recorder which is convenient for portable use is shown. An opening 2 provided at one side (the right side in the drawing) of the casing 1 has its circumference fitted on a face member 4 in the form of a rectangular tube having a bottom wall. The bottom wall portion of the face member 4 is provided with a plurality of sound inlet holes 3. A screen (not shown) consisting of porous nonwoven textile or the like for preventing penetration of dust or the like is attached to the inner surface of the face member 4. The face member 4 is fitted over a frame member 5 formed in the shape of a substantially rectangular tube. An annular groove 5*a* formed at the inner periphery portion of the frame member 5 fits over a first support member 7 formed in the shape of a substantially rectangular tube through an annular rubber member 6. The support member 7 is made of metal material for isolating vibrations of low frequency. In this embodiment the support member 7 is formed by making level material, for example, a zinc die casting in the shape of a substantially rectangular tube having a bottom wall. The support member 7 blocks up the free end portion of the frame member 5 so that a housing is formed in the inner space of the casing 1. An annular groove 7*a* formed at the inner periphery of the support member 7 is fitted over a second support member 8 of elastic material for isolating vibrations of high frequency. It is preferred that the thickness of the support member 8 is made sufficiently so as to isolate vibrations of high frequency. In this embodiment the second support member 8 includes an annular portion 8*a* which fits on the annular groove 7*a*, a cylindrical supporting portion 8*b* positioned at substantially the center of the annular portion 8*a* and having approximately an L shape cross section, and a plurality of, for example four, thin connecting portions 8*c* for connecting the supporting portion 8*b* to the annular portion 8*a*, which portions are made together as a unit body. The supporting portion 8*b* is arranged to fit over a microphone body 9 so that the body 9 is supported in a space of the housing.

According to such construction, vibrations at high and low frequencies can be isolated from the microphone body 9 by the second support member 8 and the first support member 7, respectively, from those vibrations transmitted through the casing 1 so that it is possible to improve the vibration isolating effect signifiantly as compared with the conventional microphone device and the operation of high performance microphones can be fully realized. The microphone body 9 is supported in the space of the housing by the four thin connecting portions 8*c*, so that it is possible to isolate vibration transmission and external impact vibrations can be absorbed so as to improve the vibration isolating effect greatly as compared with the conventional microphone device. The support member 8 is made in a shape of a rectangular tube having a bottom wall portion which blocks up an open end of the frame member 5 so that vibration propagated in the air can be isolated.

The microphone body 9 is electrically connected to electric circuits provided in the casing 1 of the tape recorder, for example terminals 12 of an intermediate terminal plate 11 provided at the reverse side of the support member 7, by the use of bare conductive wires 10 having 0.15 mm or less diameter. The bare conductive wires 10 are wired with a certain sag so that the wires 10 do not vibrate sympathetically with vibrations transmitted through the intermediate terminal plate 11.

According to such construction, therefore, the microphone body 9 and the intermediate terminal plate 11 are connected by the bare conductive wires 10 so that the diameter of the bare wires can be decreased significantly as compared with the conventional covered conductive wire, so as to isolate vibrations transmitted through the terminal plate 11. The diameter of the bare conductive wire 10, particularly, is made 0.15 mm or less so that vibrations of high frequency can more fully be isolated.

In addition thereto, as described above, the microphone body 9 is supported by the support member 8 through the support member 7 so that the vibration isolating effect can be best realized without impairing the operation of a high performance microphone. The microphone device according to the present invention can easily be built in a superminiature tape recorder which is convenient for portable use.

It is further understood by those skilled in the art that the foregoing description is a preferred embodiment of the disclosed device and the present invention is not limited thereto, and that various changes and modifications may be made in the present invention without departing from the spirit and scope thereof.

For example, the support member 7 for isolating vibrations of low frequency can be made in the shape of a cylinder having a bottom wall, a cylinder or an annular ring instead of a rectangular tube having a bottom wall. The support member 7 for isolating vibrations of low frequency can also be cast with the frame member 5 as a unit body instead of a separated construction.

Moreover, the bare conductive wires led out of the microphone body can be connected to electric circuits provided in the tape recorder body, directly instead of through the intermediate terminal plate.

What is claimed is:

1. A microphone device arranged to be built in a tape recorder, comprising a casing portion of a tape recorder, a face member fixed on the casing portion and having a plurality of sound inlet holes, a first support member located inside the casing portion and supported by the face member for isolating vibrations of relatively low frequency, a second support member located inside the casing portion and supported by the first support member for isolating vibrations of relatively high frequency, and a microphone body supported by the second support member in operative relation to the face member.

2. A microphone device as claimed in claim 1, wherein the first support member comprises metal material and is formed in a shape of a tubular body having a bottom wall.

3. A microphone device as claimed in claim 1, wherein the second support member comprises elastic material having sufficient elasticity to isolate the vibrations of relatively high frequency.

4. A microphone device as claimed in claim 1, further comprising a frame member extending inside the casing portion and supported by the face member, and an elastic member, wherein the first support member is supported by the frame member through the elastic member.

5. A microphone device as claimed in claim 1, wherein the first support member is cast with the frame member as a unit body.

6. A microphone device as claimed in claim 1, further comprising a pair of bare conductive wires led out of the microphone body and having 0.15 mm or less diameter.

7. A microphone device as claimed in claim 6, including an intermediate terminal plate supported inside the casing portion, and the bare conductive wires are connected to the intermediate terminal plate.

8. A microphone device as claimed in claim 6, wherein the bare conductive wires are arranged to be connected to electrical circuits provided in the casing portion.

* * * * *